US009428364B2

(12) United States Patent
Aulanko et al.

(10) Patent No.: US 9,428,364 B2
(45) **Date of Patent: *Aug. 30, 2016**

(54) ELEVATOR PROVIDED WITH A COATED HOISTING ROPE

(75) Inventors: Esko Aulanko, Kerava (FI); Jorma Mustalahti, Hyvinkää (FI); Pekka Rantanen, Hyvinkää (FI); Simo Mäkimattila, Espoo (FI)

(73) Assignee: KONE CORPORATION, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 10/969,095

(22) Filed: Oct. 21, 2004

(65) Prior Publication Data

US 2005/0060979 A1 Mar. 24, 2005

Related U.S. Application Data

(63) Continuation of application No. PCT/FI03/00418, filed on May 28, 2003.

(30) Foreign Application Priority Data

Jun. 7, 2002 (FI) ..... 20021100

(51) Int. Cl.
*B66B 11/08* (2006.01)
*B66B 7/06* (2006.01)
(Continued)

(52) U.S. Cl.
CPC ..... *B66B 11/08* (2013.01); *B66B 7/06* (2013.01); *B66B 11/008* (2013.01); *D07B 1/066* (2013.01);
(Continued)

(58) Field of Classification Search
CPC ... B66B 11/08; B66B 11/008; D07B 1/0606; D07B 1/066; D07B 1/06; D07B 1/16; D07B 1/162; D07B 1/163; F16G 1/12; F16G 1/16; F16G 1/28; F16G 9/04
USPC ..... 187/250, 251, 254, 266; 57/232, 231, 57/250, 251, 258; 254/266, 334, 393
See application file for complete search history.

(56) References Cited

U.S. PATENT DOCUMENTS 2,779,149 A * 1/1957 Schuller ..... 57/214
3,197,953 A * 8/1965 Dawbarn et al. ..... 57/216
(Continued)

FOREIGN PATENT DOCUMENTS

EP 0 444 245 A1 9/1991
EP 0 631 968 B1 9/1996
(Continued)

OTHER PUBLICATIONS

Feyrer, Klaus "Drahtseile Bemessung, Betrieb, Sicherheit", Springer Verlag, Berlin, Heidelberg, 1994, pp. 1-32.*
(Continued)

*Primary Examiner* — William A Rivera
*Assistant Examiner* — Stefan Kruer
(74) *Attorney, Agent, or Firm* — Harness, Dickey & Pierce

(57) ABSTRACT

An elevator may include: drive machine, hoisting ropes, traction sheave, elevator car, counterweight, and elevator car and counterweight guide rails. The drive machine may engage the hoisting ropes using the traction sheave. The hoisting ropes may support the elevator car on the elevator car guide rails and the counterweight on the counterweight guide rails. The hoisting ropes may include coated hoisting ropes of substantially circular cross-section. The hoisting ropes may have a load-bearing part twisted from steel wires of circular, non-circular, or circular and non-circular cross-section. A cross-sectional area of the steel wires may be less than about 0.2 $mm^2$. A strength of the steel wires may be greater than about 2000 $N/mm^2$. A core of each hoisting rope may include the load-bearing part. The core may be coated with a substantially thin sheath that forms a surface of the hoisting rope. The sheath may be softer than the core.

23 Claims, 5 Drawing Sheets

Figure 1:
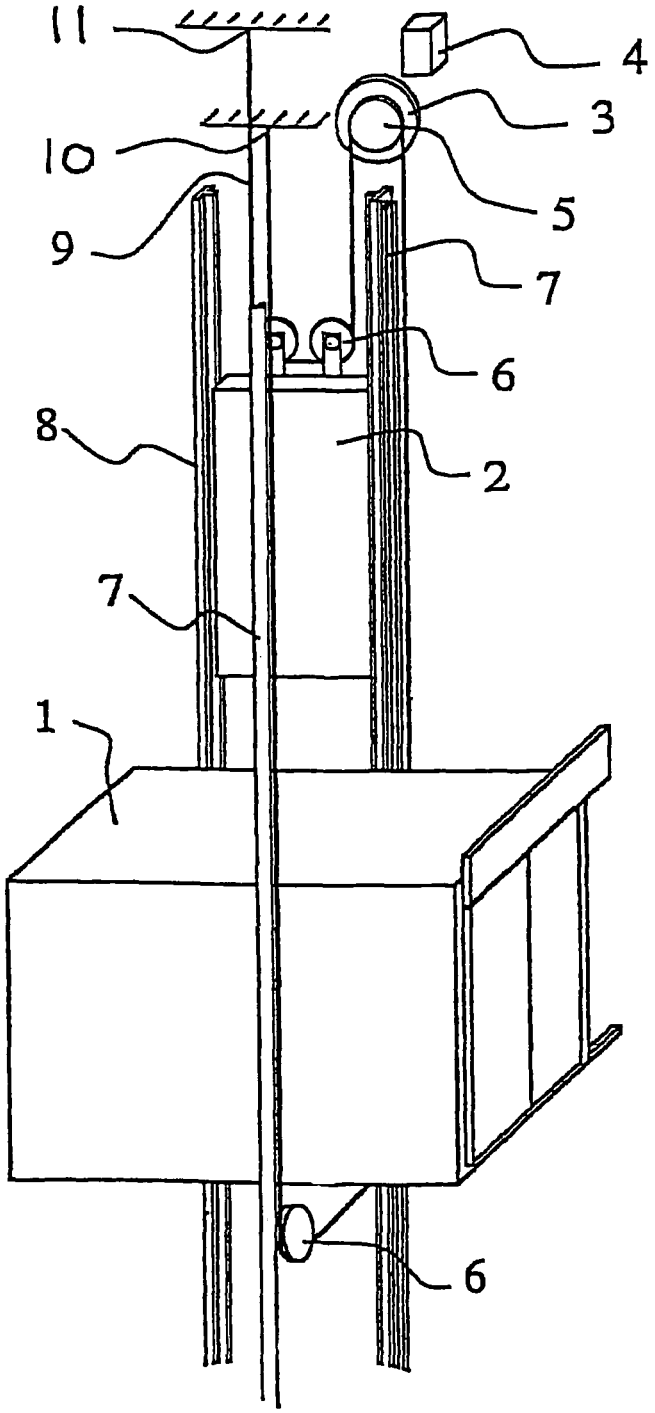
Fig. 1 (Related Art)

(51) Int. Cl.

| | |
|---|---|
| ***B66B 11/00*** | (2006.01) |
| ***D07B 1/16*** | (2006.01) |
| ***F16G 9/00*** | (2006.01) |
| *D07B 1/06* | (2006.01) |

(52) U.S. Cl.

CPC ..... *D07B 1/0673* (2013.01); *D07B 1/162* (2013.01); *D07B 1/165* (2013.01); *D07B 2201/2001* (2013.01); *D07B 2501/2007* (2013.01)

(56) References Cited

U.S. PATENT DOCUMENTS

| | | | | | |
|---|---|---|---|---|---|
| 3,519,101 | A * | 7/1970 | Sieffert | 187/256 | |
| 3,822,542 | A * | 7/1974 | Naud et al. | 57/215 | |
| 4,022,010 | A * | 5/1977 | Gladenbeck et al. | 57/231 | |
| 4,171,840 | A | 10/1979 | Berzenye | | |
| 4,344,278 | A | 8/1982 | Jamison et al. | | |
| 4,481,996 | A * | 11/1984 | De Bondt | D07B 1/0626 | 148/902 |
| 4,624,097 | A * | 11/1986 | Wilcox | 57/232 | |
| 4,676,058 | A * | 6/1987 | Foley et al. | 57/218 | |
| 4,765,937 | A * | 8/1988 | Hyon | D01F 6/14 | 264/185 |
| 5,112,933 | A * | 5/1992 | O'Donnell et al. | 528/61 | |
| 5,429,211 | A * | 7/1995 | Aulanko et al. | 187/254 | |
| 5,461,850 | A * | 10/1995 | Bruyneel et al. | 57/212 | |
| 5,651,245 | A * | 7/1997 | Damien | 57/220 | |
| 6,182,433 | B1 * | 2/2001 | Tagawa | D07B 1/062 | 57/212 |
| 6,276,120 | B1 * | 8/2001 | Adriaensen | B66B 7/06 | 57/210 |
| 6,371,448 | B1 * | 4/2002 | De Angelis | 254/374 | |
| 6,412,264 | B1 * | 7/2002 | De Josez et al. | 57/217 | |
| 6,440,579 | B1 * | 8/2002 | Hauser | C21D 8/065 | 148/504 |
| 6,508,051 | B1 * | 1/2003 | De Angelis | 57/223 | |
| 6,596,098 | B1 * | 7/2003 | Nishida et al. | 148/320 | |
| 6,601,828 | B2 * | 8/2003 | Strbuncelj et al. | 254/266 | |
| 6,667,110 | B1 * | 12/2003 | Cordonnier et al. | 428/544 | |
| 7,481,299 | B2 * | 1/2009 | Mustalahti et al. | 187/264 | |
| 7,484,596 | B2 * | 2/2009 | Aulanko et al. | 187/266 | |
| 8,020,669 | B2 * | 9/2011 | Aulanko et al. | 187/254 | |
| 2003/0089551 | A1 * | 5/2003 | Kato et al. | 182/1 | |
| 2003/0183458 | A1 * | 10/2003 | Mustalahti et al. | 187/254 | |
| 2003/0192743 | A1 * | 10/2003 | Aulanko et al. | 187/254 | |
| 2004/0016602 | A1 * | 1/2004 | Aulanko et al. | 187/254 | |
| 2004/0016603 | A1 * | 1/2004 | Aulanko et al. | 187/254 | |
| 2004/0065513 | A1 * | 4/2004 | Aulanko et al. | 187/254 | |
| 2005/0006180 | A1 * | 1/2005 | Mustalahti et al. | 187/254 | |
| 2005/0126859 | A1 * | 6/2005 | Aulanko et al. | 187/264 | |
| 2006/0231345 | A1 * | 10/2006 | Mustalahti et al. | 187/266 | |
| 2007/0017750 | A1 * | 1/2007 | Mustalahti et al. | 187/254 | |
| 2008/0041667 | A1 * | 2/2008 | Aulanko et al. | 187/254 | |
| 2010/0133046 | A1 * | 6/2010 | Allwardt et al. | 187/251 | |
| 2010/0200337 | A1 * | 8/2010 | Mustalahti et al. | 187/254 | |
| 2014/0027211 | A1 * | 1/2014 | Wesson | B66B 7/06 | 187/414 |

FOREIGN PATENT DOCUMENTS

| | | | | |
|---|---|---|---|---|
| EP | 1 022 376 | | 7/2000 | |
| EP | 1273695 | A1 | 1/2003 | |
| EP | 1391413 | A2 | 2/2004 | |
| EP | 1426482 | A1 | 6/2004 | |
| EP | 0 631 967 | B2 | 9/2004 | |
| ES | 2141851 | T3 | 9/1995 | |
| FI | 20011339 | | 6/2002 | |
| GB | 1003710 | | 9/1965 | |
| JP | 05-171580 | | 7/1993 | |
| JP | 09-021084 | | 1/1997 | |
| JP | 11-293574 | A | 10/1999 | |
| JP | 2001-262482 | | 9/2001 | |
| JP | 2003-041493 | A | 2/2003 | |
| WO | WO 98/16681 | | 4/1998 | |
| WO | WO 99/43589 | | 9/1999 | |
| WO | WO 99/43589 | A1 | 9/1999 | |
| WO | WO 0037738 | A1 * | 6/2000 | D07B 1/06 |
| WO | WO 00/50687 | | 8/2000 | |
| WO | WO 01/68973 | A1 | 9/2001 | |
| WO | WO 03/104131 | A1 | 12/2003 | |

OTHER PUBLICATIONS

Feyrer, Klaus Wires Ropes Tension, Endurance, Reliability, Springer Verlag, Berlin, Heidelberg, 2007, Section 1, pp. 4-7 and 17-26.*

European Decision dated May 18, 2010, Appl. No. 03 000 339.6, pp. 18 and 21.*

FLS, Inc., Translation Mar. 2014, Feyrer, Wire Rope Elements and Wire Ropes, Heidelberg 2000, Foreword & Translation pp. 8, 13, 16 and 40-58.*

Ralph McElroy Translation Co., Yamamori, JP 0921084 A, Wire Rope Structure, Jan. 21, 1997, pp. 1-17.*

Weiss, M.P. and Ashkenazy, R., "A Unified Fatigue and Fracture Model applied to Steel Wire Ropes", Technion IIT, Haifa, 2006, pp. 1-8.*

Z. Kawecki et al., "Achievements in wire rope production", Wire Industry (1981).*

Molkow, Michael, Dr.-Ing., "Why Wire Ropes", Elevator World, Mar. 1994, pp. 65-74.*

ASM Handbook, vol. 1, 1990, Properties and Selection: Irons, Steels, and High-Performance Alloys, ASM Handbook Committee, pp. 283-284.*

BPAI Decision, U.S. Appl. No. 10/452,311, filed Feb. 22, 2013, pp. 8-10.*

Objections Filed Against EP Application/PCT EP03725306/1517850 in the name of Kone Corporation.

Japanese Notification of Reason for Refusal (translation) mailed on Jan. 13, 2009, for corresponding Japanese Patent Application No. 2004-511211.

Japanese Notification of Reasons for Refusal (with English translation) mailed on Jan. 26, 2010, for Japanese Patent Application No. JP 2004-511211.

* cited by examiner

Prior art

ELEVATOR PROVIDED WITH A COATED HOISTING ROPE

This application is a continuation of, and claims priority under 35 U.S.C. §120 and 35 U.S.C. §365(c) from, PCT International Application No. PCT/FI03/00418 which has an International filing date of May 28, 2003, which designated the United States of America and which claims priority on FINLAND Application Priority Number 20021100 filed Jun. 7, 2002, the entire contents of which are hereby incorporated herein by reference.

Example embodiments relate to an elevator provided with a coated hoisting rope.

One of the goals in elevator development work has been to achieve an economical and efficient utilization of building space. In recent years, this development work has produced, among other things, various solutions for implementing an elevator without machine room. Good examples of elevators without machine room are disclosed e.g. in specifications EP 0 631 967 and EP 0 631 968. The elevators described in these specifications are fairly efficient in respect of space utilization, because they have made it possible to eliminate the space required in the building by the elevator machine room, without a necessity of enlarging the elevator shaft. In the elevators disclosed in these specifications, the machine is compact at least in one direction, but in other directions it may be much larger than a conventional elevator machine.

In these otherwise good elevator solutions, however, the space required by the hoisting machine constitutes a limitation on elevator lay-out options. The arrangements for the passage of the hoisting ropes take up space. The space required by the elevator car itself on its path of movement and likewise the space required by the counterweight can hardly be reduced, at least at a reasonable cost and without compromising the performance and quality of service of the elevator. In a traction sheave elevator without machine room, especially in the case of a solution with machine above, installing the hoisting machine in the elevator shaft is difficult because the machine is relatively heavy and large. The size and weight of especially a machine designed for larger loads, higher speeds and/or greater hoisting heights are such a problem in respect of installation that in practice it has even limited the range of application of the concept of elevator without machine room or at least retarded the introduction of this concept in the case of larger elevators.

Specification WO 99/43589 discloses an elevator suspended on flat belts, which achieves relatively small belt bending diameters on the traction and deflecting sheaves. However, this solution involves the problems of a restricted lay-out solution, disposition of components in the elevator shaft and orientation of deflecting pulleys. Furthermore, orientation of the polyurethane-coated belts having a load-bearing steel part inside is a problem e.g. in a situation where the car is tilted. An elevator implemented in this manner has to be fairly massive, at least as regards the machine and/or the structures supporting it, in order to avoid undesirable vibrations. Also, the massiveness of the rest of the elevator structures required to maintain the mutual orientation of the deflecting and traction sheaves increases the weight and costs of the elevator. In addition, the task of installing and adjusting such a system is difficult and requires great precision.

Specification WO 01/68973 discloses an elevator provided with coated hoisting ropes, in which the rope has been twisted from a number of coated strands and finally coated even externally with plastic or a similar material. The external diameter of the rope is specified as 12 mm, which is a large diameter in comparison with the present invention. A problem with this type of a fairly thick rope, which combines a steel wire rope and a relatively thick and soft outer layer, is that, as the rope is running around the driving or deflecting pulleys, the steel core sinks towards the bottom of the rope groove, forcing the relatively thick and soft sheath to yield out of its way. The only yielding direction is upward along the edges of the rope groove, and consequently the sheath of the rope tends to be squeezed out of the rope groove. This results in fast rope wear.

Another expedient used to achieve a small bending diameter of the rope is to employ rope structures in which the load-bearing part is made of artificial fiber. An elevator rope of this type, based on an artificial fiber structure, is disclosed in European patent application no. EP1022376. Although a solution like this does make it possible to achieve ropes lighter than steel ropes, artificial fiber ropes do not provide any essential advantage, at least not in elevators for the commonest hoisting heights, especially because artificial fiber ropes are considerably more expensive than steel ropes. In addition, the heat resistance of artificial fiber ropes e.g. in the case of fire is certainly not as good as the corresponding resistance of steel ropes.

The object of the present invention is to overcome the above-mentioned drawbacks and/or to reduce the size and/or weight of the elevator or at least its machinery by providing the possibility of using traction and deflecting sheaves of a smaller diameter. A concurrent objective is to achieve more efficient space utilization in the building.

Example embodiments of the elevator are disclosed below. Some embodiments of the invention are characterized by what is disclosed in the claims.

The invention makes it possible to achieve one or more of the following advantages, among others:

- the strong steel material employed allows the use of thin ropes
- due to the thin and hard surface material, the motion of the steel core towards the bottom of the rope groove is smaller, so the rope remains better in shape
- the thin surface material layer also makes it possible to achieve a rope with no large differences in the thickness of the filler material layer, which would make the rope non-homogeneous
- the surface material layer makes it possible to achieve a good friction between the rope and the rope groove
- as the elevator ropes are thin, the traction and rope sheaves are small and light as compared with those in conventional elevators
- a small traction sheave allows the use of smaller operating brakes in the elevator
- a small traction sheave involves a lower torque requirement, and consequently both the motor and its operating brakes can be smaller
- the use of a smaller traction sheave requires a higher rotational speed for a given elevator car speed to be achieved, which means that the same motor power output can be achieved by a smaller motor
- the use of a small traction sheave allows a smaller elevator drive machine to be used, which means a reduction in the acquisition/manufacturing costs of the drive machine
- a good grip between the traction sheave and the rope and the use of light-weight components allow the weight of the elevator car to be reduced considerably, and correspondingly a lighter counterweight can also be used than in present solutions

- a small machine size and thin, substantially round ropes allow a relatively free disposition of the elevator machine in the shaft. Thus, the elevator solution can be implemented in a variety of ways, both in the case of elevators with machine above and in the case of elevators with machine below
- the weight of the elevator car and counterweight can be completely or at least partially borne by the elevator guide rails
- in elevators applying the invention, centric suspension of the elevator car and counterweight can be easily implemented, thus reducing lateral supporting forces applied to the guide rails
- by applying the invention, efficient utilization of the cross-sectional area of the shaft is achieved
- the invention shortens the time required for the installation of the elevator and reduces the total installation costs
- the light and thin ropes are easy to handle and facilitate and accelerate the installation process considerably
- the thin and strong steel ropes of the invention have a diameter of the order of only 3-5 mm e.g. in the case of elevators designed for a nominal load below 1000 kg and speeds below 2 m/s
- using rope diameters of about 6 or 8 mm, fairly large elevators for relatively high speeds can be achieved by applying the invention,
- the invention can be applied in gearless and geared elevator motor solutions
- although the invention is primarily designed for use in elevators without machine room, it can be applied for use in elevators with machine room as well.

The primary area of application of the invention is elevators designed for the transportation of people or freight. Another primary area of application of the invention in passenger elevators whose speed range is conventionally about 1.0 m/s or higher but may also be e.g. only about 0.5 m/s. In the case of freight elevators, too, the speed is preferably at least about 0.5 m/s, although with large loads even lower speeds may be used. In the elevator of the invention, elevator hoisting ropes twisted from substantially round and strong wires coated with e.g. polyurethane are used. With round wires, the rope can be twisted in many ways using wires of different or equal thicknesses. In ropes applicable to the invention, the average wire thickness is below 0.4 mm. Well applicable ropes made from strong wires are ropes having an average wire thickness below 0.3 mm or even below 0.2 mm. For example, thin-wired strong 4-mm ropes can be twisted relatively economically from wires such that the average wire thickness in the finished rope is between 0.15 . . . 0.25 mm, in which case the thinnest wires may even have a thickness of only about 0.1 mm. Thin rope wires can easily be made very strong. The invention uses rope wires having a strength over about 2000 N/mm$^2$. A suitable range of rope wire strengths is 2300-2700 N/mm$^2$. In principle, it is possible to use rope wires having a strength as high as about 3000 N/mm$^2$ or even higher.

Figure 2:
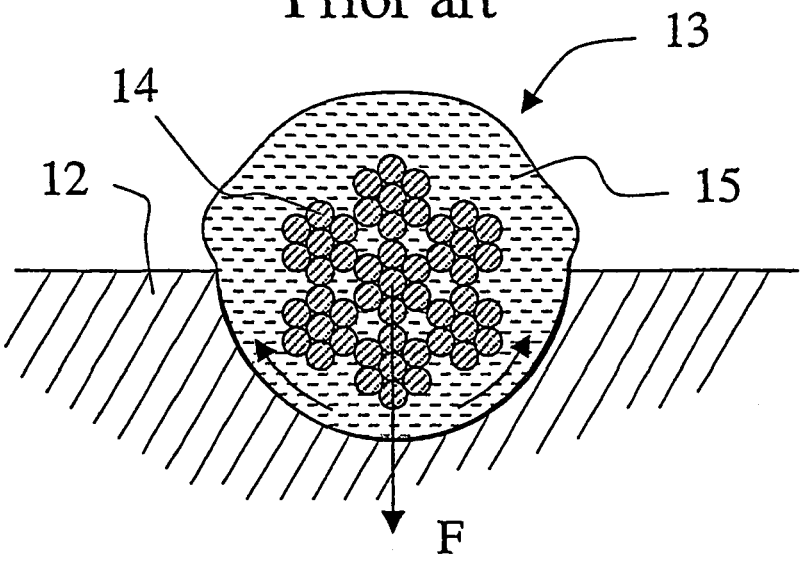
Figure 3:
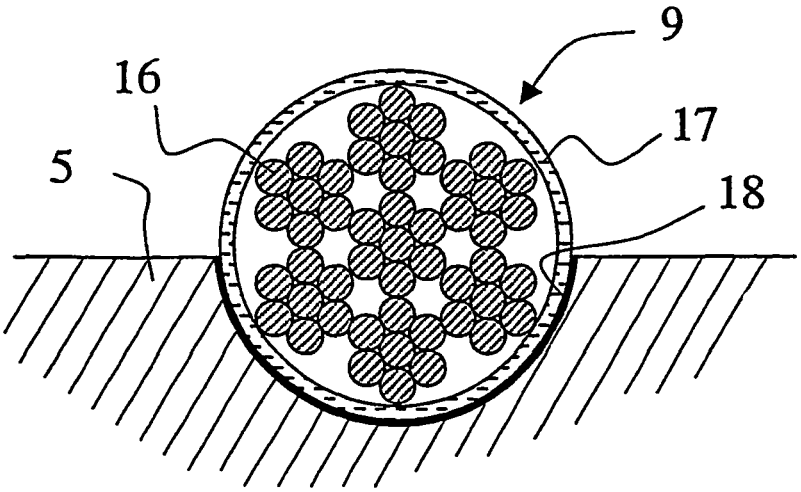
Figure 4:
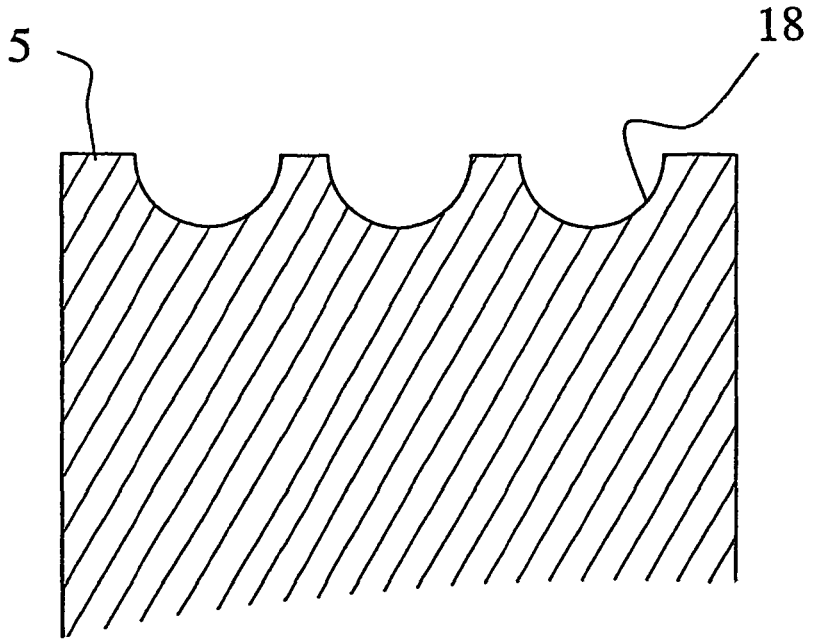
Figure 5:
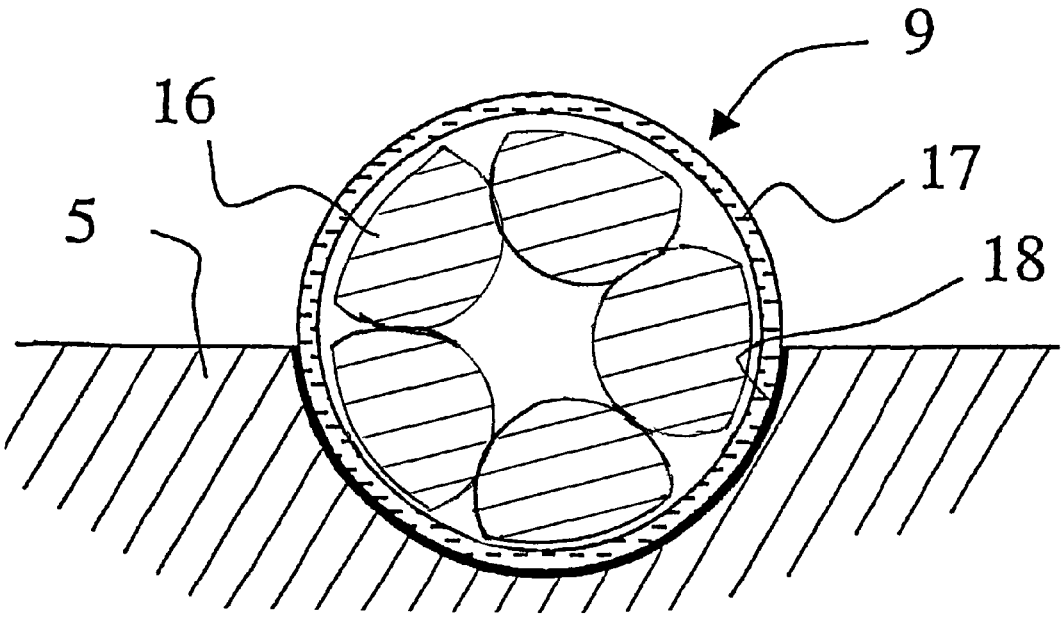
Figure 6:
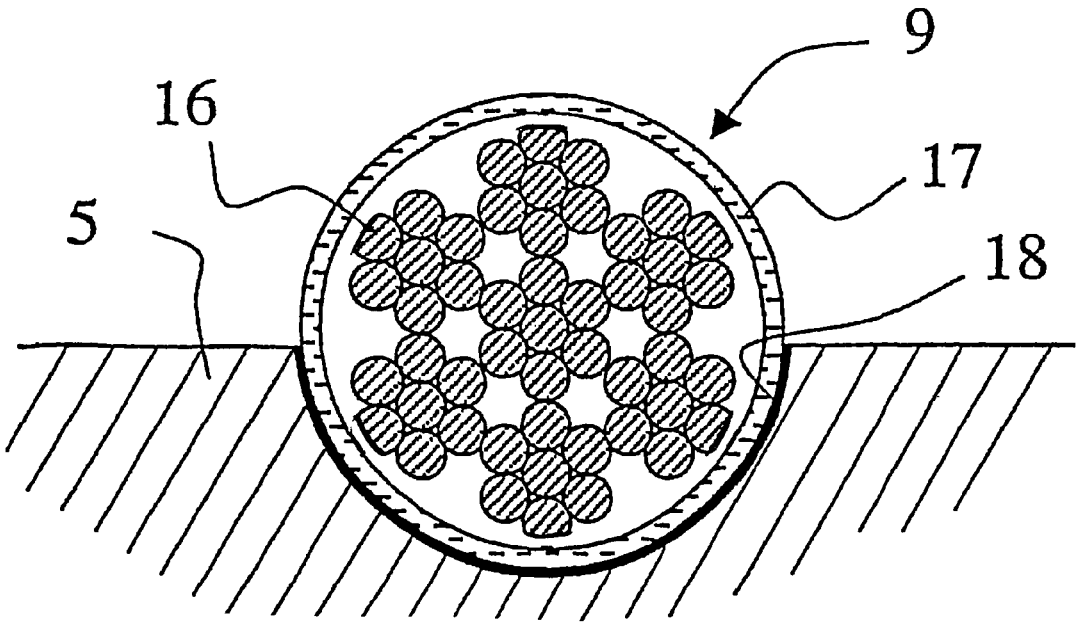
Figure 7:
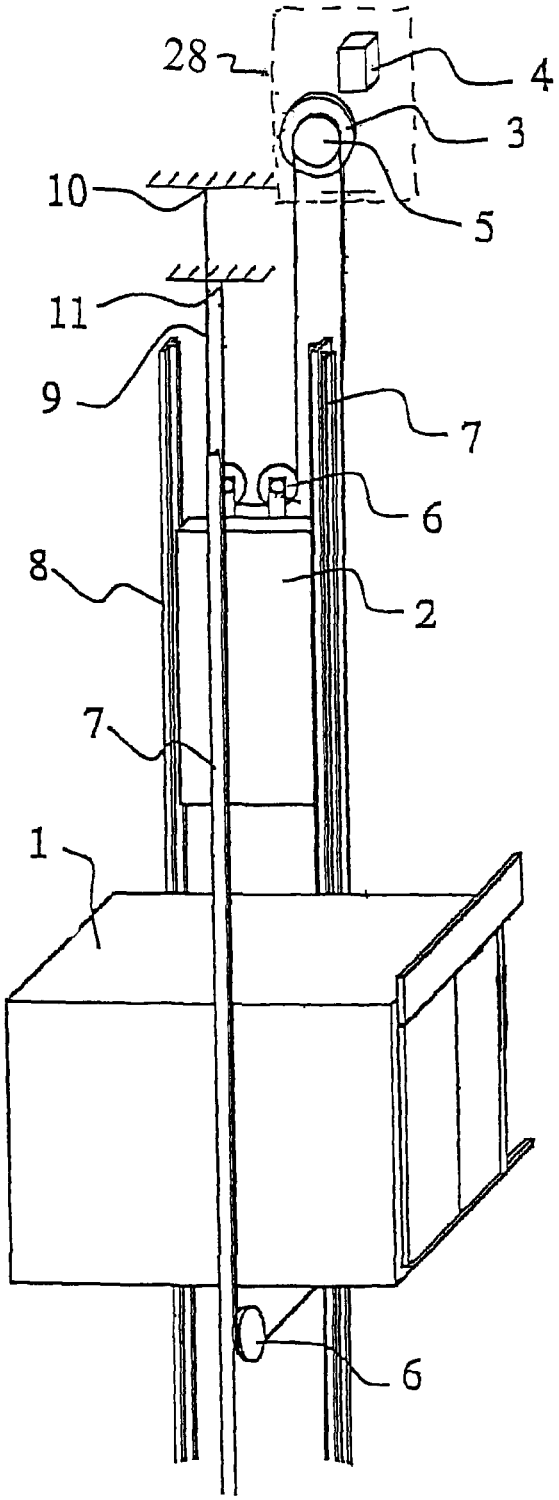
Fig. 7 (Related Art)

In the following, the invention will be described in detail by the aid of an embodiment example with reference to the attached drawings, wherein FIG. 1 presents an oblique top view of a typical elevator solution, without machine room, according to example embodiments in which coated steel ropes are used, FIG. 2 presents a cross-section of a prior-art coated steel rope, FIG. 3 presents a cross-section of a coated steel rope used in an elevator according to the invention, FIG. 4 presents a longitudinal section of a part of a rope sheave used in the elevator of the invention, FIG. 5 presents a cross-section of a coated steel rope used in an elevator according to the invention, where the load-bearing part is twisted from steel wires of non-circular cross-section, FIG. 6 presents a cross-section of a coated steel rope used in an elevator according to the invention, where the load-bearing part is twisted from steel wires of circular and non-circular cross-section, and FIG. 7 presents an oblique top view of a typical elevator solution, with machine room, according to example embodiments in which coated steel ropes are used.

FIG. 1 presents a typical elevator solution in which the hoisting rope 9 used is a coated steel rope. The elevator is preferably an elevator without machine room in which the hoisting machine 3 is connected via a traction sheave 5 to the hoisting ropes, which are coated hoisting ropes 9 of a substantially round cross-section, arranged side by side and supporting a counterweight 2 and an elevator car 1 moving on their paths, i.e. along guide rails 8 and 7. The hoisting ropes 9 placed side by side are fastened to a fixed starting point 10, from where the ropes go downwards towards a deflecting pulley 6 mounted in conjunction with the elevator car 1, substantially below the elevator car. From the deflecting pulley 6, the hoisting ropes go to a similar second deflecting pulley to the other lower edge of the elevator car and, having passed around this second deflecting pulley, the ropes go upwards to the traction sheave 5 of the elevator drive machine 3 mounted in the upper part of the elevator shaft. Having passed around the traction sheave 5 via its upper edge, the hoisting ropes go again down to the deflecting pulleys 6 connected to the counterweight 2, pass around these pulleys by their lower edge and go up again to their fixed end point 11. The functions of the elevator are controlled by a control system 4.

FIG. 2 presents a prior-art elevator rope 13 coated with polyurethane 15 or equivalent. The thickness of the polyurethane layer 15 and the cross-sectional deformation of the rope have been somewhat exaggerated for the sake of clarity. Due to the thickness of the polyurethane layer 15 or equivalent and its relatively soft mass, the force F acting on the elevator rope tends to press the steel core 14 of the rope towards the bottom of the rope groove of the rope sheave 12. This pressure correspondingly tends to displace the filler, with the result that that filler moves upwards in the direction of the bottom surface of the rope groove as indicated by the arrows and tends to expand outside the rope groove. This large deformation produces a hard strain on the rope and is therefore an undesirable situation.

FIG. 3 correspondingly presents the hoisting rope 9 of an elevator according to the invention. The core of the rope mainly consists of thin and strong steel wires 16 twisted in a suitable manner. The figure is not depicted in scale. The covering layer of the hoisting rope 9 consists of a substantially thin sheath 17, which is softer than the core and is made of rubber, polyurethane, or some other suitable non-metallic material having substantially hard properties and a high coefficient of friction. The hardness of the sheath 17 is at least over 80 Shore A, preferably between 88-95 Shore A. The thickness of the sheath 17 has been optimized with respect to durability, but it is still substantially small in relation to the diameter of the load-bearing core formed from steel wires 16. A suitable diameter of the steel wire core is between 2-10 mm, and the ratio of the core diameter to the thickness of the sheath 17 is substantially greater than 4:1, preferably between 6:1 and 12:1, and suitably, e.g., about 8:1. A suitable diameter of the steel wire core is about 4-6 mm, and in this case the sheath 17 has a thickness substantially between about 0.4-0.6 mm, preferably, e.g., 0.5 mm. The sheath 17 should preferably have a thickness at least such that it will not be immediately worn away, e.g., when a sand grain is caught between the hoisting rope 9 and the surface of the rope groove 18. In practice, a suitable range of variation of the sheath thicknesses could be, e.g., 0.3-1 mm, depending on the diameter of the core used.

The hoisting ropes 9 may have, for example, a load-bearing part twisted from steel wires of circular cross-section (e.g., FIG. 3), non-circular cross-section (e.g., FIG. 5), or circular and non-circular cross-section (e.g., FIG. 6). The elevator also may have a machine room, for example, machine room 28, as shown in FIG. 7. In this case, drive machine 3, control system 4, and/or traction sheave 5 may be located, for example, in machine room 28.

The mutual structure of the sheath 17 and the core is so constructed that the friction between the sheath 17 and the core is greater than the friction between the sheath 17 and the rope groove 18 of the traction sheave 5. Thus, any undesirable sliding that eventually may occur will occur at the desired place, i.e. between the traction sheave and the rope surface and not inside the hoisting rope between the core and the sheath, which could damage the hoisting rope 9.

FIG. 4 presents a sectional view of a part of a traction sheave 5 applying the invention. The rope grooves 18 have a substantially semi-circular cross-sectional form (e.g., the rope grooves 18 may have a semi-circular cross-sectional form). Because the hoisting ropes 9 used are considerably thinner and stronger than in a normal situation, the traction sheave and other rope sheaves can be designed to dimensions considerably smaller than when hoisting ropes of a normal size are used. For example, an external diameter of the traction sheave may be less than or equal to about 250 mm. This also makes it possible to use an elevator drive motor of smaller size and lower torque, which leads to a reduction in the acquisition costs of the motor. For example, in an elevator according to the invention, for a nominal load below 1000 kg, the traction sheave diameter is preferably 120-200 mm, but it may even be smaller than this. The diameter of the traction sheave depends on the thickness of the hoisting ropes used. Conventionally, a diameter ratio of D/d=40 is used, where D=diameter of traction sheave and d=thickness of hoisting rope. At the expense of wear resistance of the hoisting ropes, this ratio may be somewhat reduced. Alternatively, without compromising on service life, the D/d ratio can be reduced if the number of hoisting ropes is increased at the same time, in which case the strain on each hoisting rope will be smaller. Such a D/d ratio below 40 may be, e.g., a D/d ratio of about 30 or even less (e.g., D/d=25). However, reducing the D/d ratio to a value considerably below 30 often impairs the service life of the hoisting rope, radically reducing it, although this can be compensated by using hoisting ropes of special construction. Achieving a D/d ratio below 20 is very difficult in practice, but it might be achieved by using a hoisting rope specially designed for this purpose, although such a hoisting rope would most probably be expensive.

By virtue of the small traction sheave, in an elevator according to the invention for a nominal load e.g. below 1000 kg, a machine weight as low as about one half of the present machine weights can easily be achieved, which means elevator machines having a weight as low as below 100-150 kg. In the invention, the machine is regarded as comprising at least the traction sheave, the motor, the machine housing structures and the brakes.

It will be easy to achieve an elevator in which the machine without supporting elements has a dead weight below 1/7 of the nominal load or even about 1/10 of the nominal load or even still less. Basically, the ratio of machine weight to nominal load is given for a conventional elevator in which the counterweight has a weight substantially equal to the weight of an empty car plus half the nominal load. As an example of machine weight in the case of an elevator of a given nominal weight when the fairly common 2:1 suspension ratio is used with a nominal load of 630 kg, the combined weight of the machine and its supporting elements may be only 75 kg when the traction sheave diameter is 160 mm and hoisting ropes having a diameter of 4 mm are used, in other words, the total weight of the machine and its supporting elements is about 1/8 of the nominal load of the elevator. More generally, when a suspension ratio of 2:1 is used, the thin and strong steel ropes of the invention have a diameter of 2.5-5 mm in elevators for a nominal load below 1000 kg and preferably about 5-8 mm in elevators for a nominal load over 1000 kg. In principle, it is possible to use ropes thinner than this, but in this case a large number of ropes will be needed unless e.g. the suspension ratio is increased.

By using a polyurethane or similar coating, the smoothness of the rope is also improved. The use of thin wires allows the rope itself to be made thinner, because thin steel wires can be made stronger in material than thicker wires. For instance, using wires of about 0.2 mm, a 4 mm thick elevator hoisting rope of a fairly good construction can be produced. Depending on the thickness of the hoisting rope used and/or for other reasons, the wire thicknesses in the steel wire rope may preferably range between 0.15 mm and 0.5 mm, in which range there are readily available steel wires with good strength properties in which even an individual wire has a sufficient wear resistance and a sufficiently low susceptibility to damage.

In the above, ropes made from round steel wires have been discussed. Applying the same principles, the ropes can be wholly or partly twisted from non-round profiled wires. In this case, the cross-sectional areas of the wires are preferably substantially the same as for round wires, i.e. in the range of 0.015 $mm^2$-0.2 $mm^2$. Using wires in this thickness range, it will be easy to produce steel wire ropes having a wire strength above about 2000 $N/mm^2$ and a wire cross-section of 0.015 $mm^2$-0.2 $mm^2$ and comprising a large cross-sectional area of steel material in relation to the cross-sectional area of the rope, as is achieved e.g. by using the Warrington construction. For the implementation of the invention, particularly well suited are ropes having a wire strength in the range of 2300 $N/m^2$-2700 $N/mm^2$, because such ropes have a very large bearing capacity in relation to rope thickness while the high hardness of the strong wires involves no substantial difficulties in the use of the rope in elevators.

The coating material selected for use in the steel ropes is a material that has good frictional properties and a good wear resistance and is substantially hard as mentioned before. The coating of the steel ropes can also be so implemented that the coating material penetrates into the rope partially or through the entire rope thickness. For example, at least part of spaces between the steel wires in the hoisting ropes may be filled with at least one of rubber, urethane, and other medium of substantially non-fluid nature.

It is obvious to the person skilled in the art that the invention is not limited to the example described above, but that it may be varied within the scope of the claims presented below. In accordance with the examples described above, the skilled person can vary the embodiment of the invention e.g. by using a suitable coating in the rope grooves.

It is also obvious to the person skilled in the art that the ropes may be twisted in many different ways. Likewise, the average of the wire thicknesses may be understood as referring to a statistical, geometrical or arithmetical mean value. To determine a statistical average, it is possible to use e.g. the standard deviation or the Gauss distribution. It is further obvious that the wire thicknesses in the rope may vary, e.g. even by a factor of 3 or more.

It is further obvious to the person skilled in the art that the ropes may be constructed in many different ways. The sheath may have e.g. a double-layer structure comprising a somewhat softer outer layer of polyurethane or equivalent that has good frictional properties and a harder inner layer of polyurethane or equivalent.

It is also obvious to the skilled person that the lay-out of the elevator solution used may differ in may ways from that described above. Thus, the elevator drive machine 3 may be placed lower in the elevator shaft than in the above description, for instance so that the hoisting ropes 9 pass around the traction sheave 5 by its lower side. In this case, the deflecting pulleys may correspondingly be fixedly placed in the upper part of the elevator shaft.

The invention claimed is:

1. An elevator without a machine room, the elevator comprising:

a drive machine;

a set of hoisting ropes;

a traction sheave having a plurality of rope grooves;

an elevator car;

a counterweight;

elevator car guide rails; and counterweight guide rails;

wherein the drive machine engages the set of hoisting ropes using the traction sheave, wherein the set of hoisting ropes supports the elevator car moving on the elevator car guide rails, wherein the set of hoisting ropes supports the counterweight moving on the counterweight guide rails, wherein the set of hoisting ropes includes coated hoisting ropes of substantially circular cross-section, wherein the hoisting ropes have a load-bearing part twisted from steel wires of circular cross-section, non-circular cross-section, or circular and non-circular cross-section, wherein a cross-sectional area of the steel wires of each hoisting rope is greater than 0.015 $mm^2$ and less than 0.2 $mm^2$, wherein a strength of the steel wires is greater than 2300 $N/mm^2$, wherein a core of each hoisting rope includes the load-bearing part, wherein the core of each hoisting rope is coated with a substantially thin sheath that forms a surface of the hoisting rope, wherein the sheath is softer than the core, wherein a diameter of the core of each hoisting rope is a diameter of the hoisting rope excluding only the sheath, wherein the diameter of the core is greater than or equal to 2.5 mm and less than or equal to 8 mm, wherein each of the plurality of rope grooves is of a substantially semi-circular cross-sectional form, and wherein each of the plurality of rope grooves is coated.

2. The elevator of claim 1, wherein the sheath of the hoisting ropes is made from at least one of rubber, polyurethane, and other non-metallic material, and wherein the sheath has a hardness greater than 80 Shore A.

3. The elevator of claim 2, wherein the hardness of the sheath is greater than or equal to 88 Shore A and less than or equal to 95 Shore A.

4. The elevator of claim 1, wherein a ratio of the diameter of the core to a thickness of the sheath is substantially greater than 4:1.

5. The elevator of claim 4, wherein the ratio of the diameter of the core to the thickness of the sheath is greater than or equal to about 6:1 and less than or equal to 12:1.

6. The elevator of claim 4, wherein the ratio of the diameter of the core to the thickness of the sheath is 8:1.

7. The elevator of claim 1, wherein the diameter of the core of each hoisting rope is greater than or equal to 4 mm and less than or equal to 6 mm, and wherein the sheath has a thickness greater than or equal to 0.4 mm and less than or equal to 0.6 mm.

8. The elevator of claim 7, wherein the thickness of the sheath is 0.5 mm.

9. The elevator of claim 1, wherein an external diameter of the traction sheave is less than or equal to 250 mm.

10. The elevator of claim 1, wherein at least part of spaces between the steel wires in the hoisting ropes is filled with at least one of rubber, urethane, and other medium of substantially non-fluid nature.

11. The elevator of claim 1, wherein an external diameter of the traction sheave is less than 200 mm.

12. The elevator of claim 1, wherein a ratio of an external diameter of the traction sheave to a thickness of each hoisting rope is less than 40:1.

13. The elevator of claim 1, wherein a thickness of the sheath depends on the diameter of the core on which the sheath is formed, and wherein a ratio of the diameter of the core to the thickness of the sheath is substantially greater than 4:1.

14. The elevator of claim 1, wherein the core of each hoisting rope is coated with a separate and substantially thin sheath that forms the surface of the hoisting rope, and the surface of each coated core has a substantially circular cross-section.

15. An elevator with a machine room, the elevator comprising:

a drive machine;

a set of hoisting ropes;

a traction sheave including a plurality of rope grooves;

an elevator car;

a counterweight;

elevator car guide rails; and counterweight guide rails;

wherein the drive machine engages the set of hoisting ropes using the traction sheave, wherein the set of hoisting ropes supports the elevator car moving on the elevator car guide rails, wherein the set of hoisting ropes supports the counterweight moving on the counterweight guide rails, wherein the set of hoisting ropes includes coated hoisting ropes of substantially circular cross-section, wherein the hoisting ropes have a load-bearing part twisted from steel wires of circular cross-section, non-circular cross-section, or circular and non-circular cross-section, wherein a cross-sectional area of the steel wires of each hoisting rope is greater than 0.015 $mm^2$ and less than 0.2 $mm^2$, wherein a strength of the steel wires is greater than 2300 $N/mm^2$, wherein a core of each hoisting rope includes the load-bearing part, wherein the core of each hoisting rope is coated with a substantially thin sheath that forms a surface of the hoisting rope, wherein the sheath is softer than the core, wherein a diameter of the core of each hoisting rope is a diameter of the hoisting rope excluding only the sheath, wherein the diameter of the core is greater than or equal to 2.5 mm and less than or equal to 8 mm, wherein each of the plurality of rope grooves is of a substantially semi-circular cross-sectional form, and wherein each of the plurality of rope grooves is coated.

16. The elevator of claim 15, wherein an external diameter of the traction sheave is less than or equal to 250 mm.

17. The elevator of claim 15, wherein an external diameter of the traction sheave is less than 200 mm.

18. The elevator of claim 15, wherein a ratio of an external diameter of the traction sheave to a thickness of each hoisting rope is less than 40:1.

19. The elevator of claim 15, wherein a thickness of the sheath depends on the diameter of the core on which the sheath is formed, and wherein a ratio of the diameter of the core to the thickness of the sheath is substantially greater than 4:1.

20. An elevator, comprising:

a drive machine;

a set of hoisting ropes;

a traction sheave including a plurality of rope grooves;

an elevator car;

a counterweight;

elevator car guide rails; and counterweight guide rails;

wherein the drive machine engages the set of hoisting ropes using the traction sheave, wherein the set of hoisting ropes supports the elevator car moving on the elevator car guide rails, wherein the set of hoisting ropes supports the counterweight moving on the counterweight guide rails, wherein the set of hoisting ropes includes coated hoisting ropes of substantially circular cross-section, wherein the hoisting ropes have a load-bearing part twisted from steel wires of circular cross-section, non-circular cross-section, or circular and non-circular cross-section, wherein a cross-sectional area of at least some of the steel wires of the hoisting ropes is 0.008 $mm^2$, wherein a strength of the steel wires is greater than 2300 $N/mm^2$, wherein a core of each hoisting rope includes the load-bearing part, wherein the core of each hoisting rope is coated with a substantially thin sheath that forms a surface of the hoisting rope, wherein the sheath is softer than the core, wherein a diameter of the core of each hoisting rope is a diameter of the hoisting rope excluding only the sheath, wherein the diameter of the core is greater than or equal to 2.5 mm and less than or equal to 8 mm, wherein each of the plurality of rope grooves is of a substantially semi-circular cross-sectional form, and wherein each of the plurality of rope grooves is coated.

21. The elevator of claim 20, wherein the elevator does not include a machine room.

22. The elevator of claim 20, wherein the elevator includes a machine room.

23. The elevator of claim 20, wherein a thickness of the sheath depends on the diameter of the core on which the sheath is formed, and wherein a ratio of the diameter of the core to the thickness of the sheath is substantially greater than 4:1.

* * * * *